United States Patent [19]

Wing

[11] 4,365,627

[45] Dec. 28, 1982

[54] FILTER-TYPE RESPIRATOR CANISTER

[75] Inventor: Richard E. Wing, Midland, Mich.

[73] Assignee: The Dow Chemical Company, Midland, Mich.

[21] Appl. No.: 189,446

[22] Filed: Sep. 22, 1980

[51] Int. Cl.[3] ..... A62B 7/00

[52] U.S. Cl. ..... 128/202.22; 128/205.27; 55/DIG. 33; 55/DIG. 34; 55/DIG. 35; 55/274; 116/DIG. 25; 116/206

[58] Field of Search ..... 128/202.22, 205.27; 55/DIG. 33, DIG. 34, DIG. 35, 274; 73/38; 116/DIG. 25, 206

[56] References Cited

U.S. PATENT DOCUMENTS 4,050,291 9/1977 Nelson ..... 73/38

4,154,586 5/1979 Jones et al. ..... 55/DIG. 34

FOREIGN PATENT DOCUMENTS 919632 9/1954 Fed. Rep. of Germany ..... 73/38

2758603 7/1978 Fed. Rep. of Germany ..... 128/202.22

170404 10/1921 United Kingdom ..... 55/DIG. 33

*Primary Examiner*—Henry J. Recla

*Attorney, Agent, or Firm*—James H. Dickerson, Jr.

[57] ABSTRACT

An improved canister for a filter-type respirator having an end-of-service life warning device which is located in a position such that all air flowing through the canister flows through the warning device after the air has flowed through at least about 50 volume percent of the filtering material contained in the respirator.

3 Claims, 3 Drawing Figures

FILTER-TYPE RESPIRATOR CANISTER

BACKGROUND OF THE INVENTION

Where it is not practicable to control an air contamination in the breathing zone of workmen by adequate exhaust ventilation, etc., and it is necessary for persons to be exposed to harmful amounts of dust, smoke, fumes or gases, personal respiratory equipment is frequently used to protect the worker. Such equipment is not, in general, suited for prolonged daily use because of the inherent features of discomfort and inconvenience to the wearer. For emergency or temporary situations, or until effective control of contamination can be developed and applied, personal respiratory protection is frequently used to protect the worker from harmful exposures.

One type of personal respiratory protection which is commonly used is a filter-type respirator. Filter-type respirators may be either chemical-filter respirators or mechanical-filter respirators. Chemical-filter respirators removed harmful constituents from air passing through them by chemical reactions, absorption and adsorption and include ordinary gas masks and chemical respirators. Mechanical-filter respirators remove harmful constituents from air passing through them by mechanical filtration and include dust, mist or fume respirators.

Unlike supplied-air or supplied-oxygen respirators, filter-type respirators may be used only in areas where there is sufficient ambient oxygen to sustain life. Oxygen is not supplied by filter-type respirators. The only function performed by filter-type respirators is to remove air contaminants.

Since filter-type respirators are primarily used for emergencies, respirators are carried by workers throughout their work day so they will be readily available if needed. However, due to ambient air contaminants in the atmosphere, the respirator's ability to remove air contaminants decreases from the day the respirator is first exposed to the atmosphere. Thus, it is possible that the effectiveness may end, even though the respirator was never used to protect a worker. Likewise, if an emergency occurs and the respirator is put into use to protect a worker, the respirator's utility in removing contaminants slowly decreases until it is no longer effective. At that time, the respirator offers no protection to the worker.

Filter-type respirators frequently are unsafe because a worker may assume the respirator is effective, when, in fact, it has lost its ability to remove air contaminants because it has been consumed in a prior emergency or because it has been depleted by removing ambient air contaminants. Visual inspection of a filter-type respirator will not indicate whether the respirator is effective or has been depleted. Attempts have been made to overcome this problem by adding color changing indicators to the filtering material.

For many gases, charcoal is used totally or partially as the absorbent. Since charcoal is solid black, a color change of the absorbent would not be detectable and would be useless. Thus, for the most common uses for filter-type respirators, coating the absorbent with a color changing indicator and enclosing it in a visible enclosure will provide insufficient warning to the user.

Canisters having end-of-service life indicators are shown in U.S. Pat. Nos. 1,537,519 to Yablick; 3,966,440 to Roberts; 4,155,358 to McAllister et al.; and 4,154,586 to Jones and Ayes.

SUMMARY OF THE INVENTION

An improved filter-type respirator canister has been developed. The canister comprises an air inlet; an air outlet; a bed of filtering material capable of removing one or more air impurities and located within the canister between the air inlet and the air outlet; and an end-of-service life device which is located in a position such that all air passes through the warning device after the air has passed through at least about 50 volume percent of the bed of filtering material.

DETAILED DESCRIPTION OF THE DRAWINGS

Figure 1:
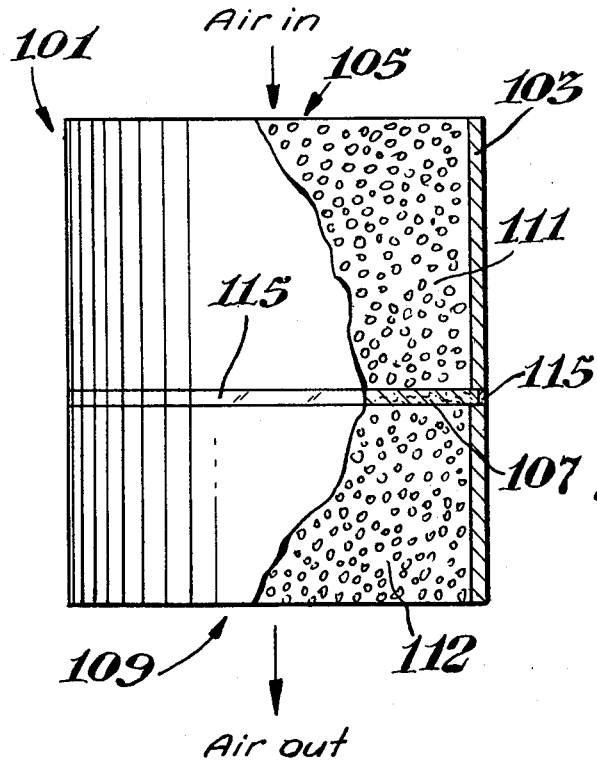
FIG. 1 shows one embodiment of the invention: a canister having a flow-through end-of-service life warning device.

FIG. 1 shows one embodiment of the improved filter-type canister. The canister 101 has an air inlet 105 and an air outlet 109. Contained within the canister is filtering material. At least about 50 volume percent of the filtering material 111 is positioned between the air inlet 105 and an end-of-service life warning device 107. The remaining portion of the filtering material 112 is positioned between the warning device 107 and the air outlet 109. The canister body 103 may be transparent over its entire surface or transparent only at a portion of the surface 115 which is adjacent to the warning device 107. All that is necessary is that the warning device be visible to a user of the canister.

In operation, air is flowed into the canister through air inlet 105 and into the bed of filtering material 111. The air then passes through the bed of filtering material 111 to, and through, the end-of-service life warning device 107. The air thereafter passes through the remainder of the filtering material 112 and out of the canister through the air outlet 109. Any impurities contained in the air are removed as they pass through the beds of filtering material 111 and 112. As impurities are removed, the filtering material becomes incrementally saturated and no longer removes the impurities. After a certain amount of air has passed through the filter bed 111, air which still contains impurities contacts the end-of-service life warning device 107. Present in the warning device 107 is an indicator which changes color when exposed to the air impurities. Since the warning device 107 is visible to a user of the canister, the user can see the change of color and is thereby warned that the canister is almost depleted and will soon be ineffective. However, because air impurities are still removed as the air passes through the remaining filtering particles 112, the canister continues to remove air impurities for a certain time after the end-of-service life warning device 107 changes color. Thus, the user is warned so he can seek safety or change respirators or change canisters.

Figure 2:
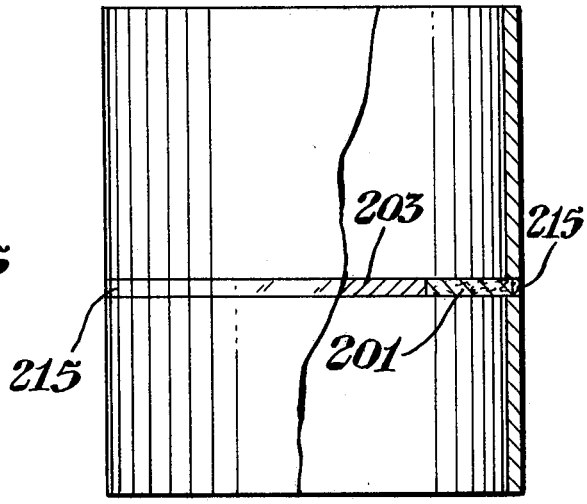
FIG. 2 shows the warning device having a solid center, thus forcing air to the periphery of the warning device.

FIG. 2 shows another embodiment of the invention wherein a central portion 203 of the warning device is solid and will prevent air from flowing therethrough.

Rather than flowing through any part of the warning device, the air is forced to flow around the outer edge 201 of the end-of-service life warning device. This assures that the portion of the warning device visible to a user of the canister changes color. The entire canister may be transparent or only the portion 215 adjacent to the warning device.

Figure 3:
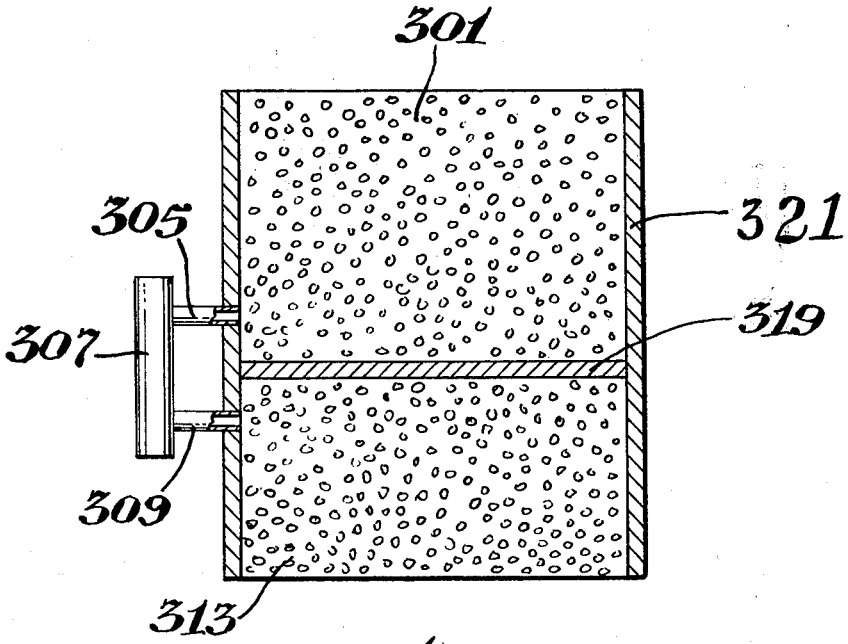
FIG. 3 shows the warning device physically separate from the canister, but attached thereto.

FIG. 3 shows another embodiment of the invention wherein the end-of-service life warning device 307 is connected to the canister 321 by conduits 305 and 309. Yet the warning device 307 is spaced apart from the canister 321. In this manner, the warning device may be located in a position which makes viewing by a user of the canister easier. Inside the canister 321, there must be a shield 319 to force the air to flow through the warning device 307 before the air flows through the remaining bed of filtering particles 313. The warning device 307 should be constructed from materials which allow a user to see any color change occurring in the warning device.

The improved filter-type respirator canister may be used to remove many different types of impurities from air. The impurity being removed must, however, be matched with a color-changing indicator such that the indicator will change colors when exposed to the air impurity. For example, acid gases such as chlorine or bromine may be removed. An appropriate indicator might be phenolphthalein or methyl red.

Persons skilled in the art are able to match a color change indicator to many types of air impurities. Examples of color change indicators are shown in books such as *The Handbook of Chemistry and Physics* and other well known reference books available to those skilled in the art. Examples of indicators which change colors when exposed to vinyl chloride are shown in U.S. Pat. Nos. 3,966,440; 4,155,358 and 4,154,586.

Optionally, the warning device may contain an electrical device capable of detecting the presence of an air impurity. The device may be constructed so that it will sound an audible alarm or will cause a warning light to be lit when the impurity is detected. The art of electrical detectors has progressed to the point that detectors may be constructed to detect acid gases, mists, dust and many other air impurities. Persons skilled in the art are able to design or select devices which will detect given air impurities.

Optionally, the warning device indicator may be a substance which, when exposed to an air impurity, may release a chemical which a user may detect by its taste or smell. In this manner, the user will be warned that the canister is nearly depleted.

Optionally, a combination of warning devices may be used. Canisters may have one or more warning devices: color change, audible signal, taste and/or smell.

Likewise, filtering materials which are suitable to remove various air impurities are well known to those skilled in the art. Materials such as activated carbon are commonly used. However, the selection of the filtering material has no effect on the operation of the warning device. They operate independently except for the fact that the warning device shows the user that a portion of the filtering material has been depleted and is no longer removing impurities from the air.

In all embodiments of the present invention, it is necessary that the warning device be enclosed in a transparent case so a color change may be seen by a user. It is not necessary that the entire canister be transparent although it may be.

What is claimed is:

1. An improved filter-type respirator canister having a housing which has an air inlet; an air outlet; a bed of filtering material, capable of removing one or more air impurities, located within the housing and between the air inlet and the air outlet; and an end-of-service life warning device having an indicator which changes color when exposed to air impurities;

wherein the improvement comprises:

the end-of-service life warning device having a solid center and an air permeable peripheral edge positioned transverse to air flow passage through the housing and attached to and supported by the housing whereby all of the air flowing through the device flows through the peripheral edge of the device; and at least a portion of said peripheral edge containing an indicator which changes color when exposed to air impurities; and said housing being transparent at least adjacent to said indicator whereby said indicator is visible from the exterior of said canister.

2. The canister of claim 1 wherein the warning device is located nearer to the air outlet than to the air inlet.

3. The canister of claims 1 wherein the warning device changes color when exposed to acid gases.

* * * * *